US005387082A

United States Patent [19]

Matyscak

[11] Patent Number: 5,387,082

[45] Date of Patent: Feb. 7, 1995

[54] GUIDE WAVE SUSPENSION FOR AN AXIAL-FLOW TURBOMACHINE

[75] Inventor: Kamil Matyscak, Brenden, Germany

[73] Assignee: Asea Brown Boveri Ltd., Baden, Switzerland

[21] Appl. No.: 121,317

[22] Filed: Sep. 15, 1993

[30] Foreign Application Priority Data

Oct. 5, 1992 [EP] European Pat. Off. ..... 92116970

[51] Int. Cl.[6] ..... F04B 29/60

[52] U.S. Cl. ..... 415/209.2; 415/139; 415/209.3

[58] Field of Search ..... 415/139, 189, 209.2, 415/209.3, 209.4

[56] References Cited

U.S. PATENT DOCUMENTS

| | | | |
|---|---|---|---|
| 3,004,700 | 10/1961 | Warren . | |
| 3,104,091 | 9/1963 | Vivian | 415/209.4 |
| 3,427,000 | 2/1969 | Scalzo . | |
| 3,542,483 | 11/1970 | Gagliardi | 415/139 |
| 3,892,497 | 7/1975 | Gunderlock et al. | 415/209.3 |
| 3,981,609 | 9/1976 | Koenig | 415/117 |
| 4,009,969 | 3/1977 | Kadera et al. | 415/189 |
| 5,224,824 | 7/1993 | Eng | 415/209.3 |

FOREIGN PATENT DOCUMENTS

| | | | |
|---|---|---|---|
| 0212534 | 7/1957 | Australia | 415/209.2 |
| 647384 | 12/1950 | United Kingdom . | |
| 689270 | 3/1953 | United Kingdom . | |
| 0786689 | 11/1957 | United Kingdom | 415/139 |

*Primary Examiner*—John T. Kwon
*Assistant Examiner*—Mark Sgantzos
*Attorney, Agent, or Firm*—Burns, Doane, Swecker & Mathis

[57] ABSTRACT

In a gas turbine having a plurality of vane carrier segments (2, 2') suspended coaxially in a machine casing (3) the guide vanes (11, 11') are held by their roots (14, 14') in such a manner that the root (14) of each guide vane engages in each case in two vane carrier segments (2, 2') adjoining one another in the axial direction. The roots (14) of the guide vanes (11) are provided with a collar (15) which extends in the axial direction to the inlet plane (16) of the rotor blade (12) lying upstream. The collar makes a seal there against the root (14') of another guide vane (11').

5 Claims, 3 Drawing Sheets

GUIDE WAVE SUSPENSION FOR AN AXIAL-FLOW TURBOMACHINE

BACKGROUND OF THE INVENTION

1. Field of the Invention

The invention relates to an axial-flow turbomachine, particularly a gas turbine, having a plurality of vane carrier segments which are suspended coaxially in a machine casing and in which the guide vanes are held by their roots, the root of each guide vane engaging in each case in two vane carrier segments adjoining one another in the axial direction.

2. Discussion of Background

Axial-flow turbomachines are usually equipped with a vane carrier for the guide vanes which is suspended coaxially in a casing, while both the casing and the vane carrier are provided with a horizontal junction plane in which their respective top and bottom halves are bolted together.

In unsteady operation, such as frequently occurs in power station gas turbines in the covering of peak loads, thermal stresses and differential expansions arise in the casings and lead to deformations of the casings and to variations of clearance between casing and rotor. Thus, for example, in such thermal turbomachines the problem of the ovalization of the axially divided casings concerned is as old as the machines themselves. The causes of these undesirable deformations are to be seen mainly in the presence of temperature gradients over the thickness of the wall, which give rise to a difference in creep between the outer and inner fibers respectively, and in the asymmetry caused by the junction planes.

In highly loaded gas turbines, in which the vane carriers assume temperatures of 400° to 450° C. during operation despite being cooled, a variation of the cooling could possibly affect the ovalization. However, the radial expansion of the vane carrier could thereby be affected in such a manner that vane clearances are thereby reduced, which would lead to an increased risk of grazing.

Another measure consists in dispensing with the vane carrier in the form of half-shells bolted together and in suspending the guide vanes in vane carrier segments of the kind mentioned above. These vane carrier segments are in turn suspended in radial ribs of the casing. This solution is based on the fact that the thermal deformation of the outer casing is less than that of a half-shell vane carrier. The guide vanes are in this case held by their roots in the vane carrier segments, the root of each guide vane engaging in each case in two vane carrier segments adjoining one another in the axial direction. A disadvantage of this arrangement is that the faces of the vane carrier segments form the walls which limit the flow in the turbomachine and, as such, are exposed to the high temperatures prevailing in the flow duct. Consequently, the segments must be made of a high-grade material.

SUMMARY OF THE INVENTION

Accordingly, one object of this invention is to avoid this disadvantage and to provide a novel arrangement in which, in an axial-flow turbomachine of the type indicated in the introduction, the roots of the guide vanes are provided with a collar which extends in the axial direction at least to the inlet plane of the rotor blade lying upstream or to the outlet plane of the rotor blade lying downstream, and there makes a seal against the root of another guide vane. This collar thus forms the flow-limiting wall in the plane of the rotor blade and protects the segments against impermissible heating.

The annular space bounded by the vane carrier segments and the collar of the vane roots is expediently brought into communication with a cooling air space by way of a bore provided in the vane carrier segments. Since the other free surfaces of the segments also project into axially adjoining cooling air spaces, in which the air is also made available for cooling the guide vanes, the segments are thus cooled relatively uniformly all around.

For the purpose of sealing these adjoining cooling air spaces in the axial direction, the vane carrier segments are provided in the peripheral direction with interengaging toothing.

It is advantageous for a vane carrier segment to hold at least three vane roots of the same guide row and to be secured in position in the turbine casing by means of a screw. If the screw is disposed at the center of the segment, expansion of each segment on both sides in the peripheral direction is thereby ensured, so that the segment ends grow into the toothings, which for this purpose are given appropriate clearance.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings where the invention is illustrated by way of an exemplary embodiment in the form of an axial-flow gas turbine and wherein.

Only the elements essential to the understanding of the invention are shown. Of the plant, for example, the compressor part, the combustion chamber and the complete exhaust gas duct and the flue are not shown. The direction of flow of the working medium is indicated by arrows.

DESCRIPTION OF THE PREFERRED EMBODIMENTS

Figure 1:
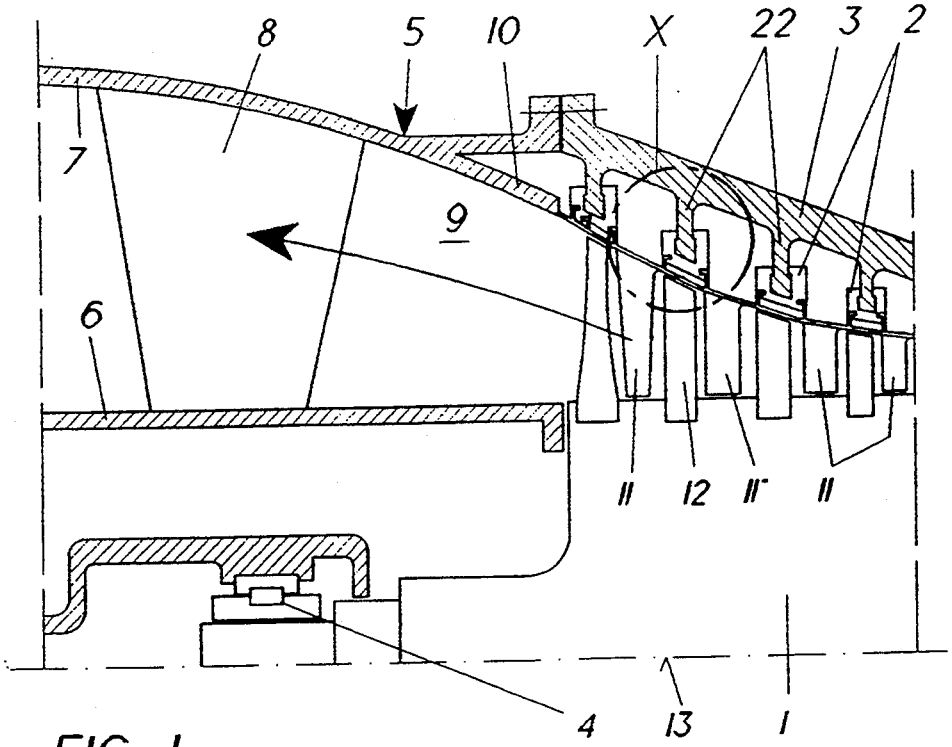
FIG. 1 is a partial longitudinal section of the gas turbine.

Referring now to the drawings, wherein like reference numerals designate identical or corresponding parts throughout the several views, the gas turbine, of which FIG. 1 shows only above the machine axis 13 the exhaust side and the last four axial-flow stages, consists essentially of the rotor 1 equipped with rotor blades and the vane carrier segments 2 equipped with guide vanes. These segments 2 are suspended with the aid of hammer-head slots (FIG. 2) in corresponding holders in the machine casing 3, which is here a turbine casing 3. They are suspended in radial ribs 22 which are integrally molded with the casing.

The exhaust gas casing 5 is flanged to the turbine casing and consists essentially of an annular inner part 6 on the hub side and an annular outer part 7, these parts bounding the diffuser 9. The two elements 6 and 7 may be half-shells having an axial junction plane or be one-piece pot casings. They are joined together by a plurality of radial flow ribs 8, which are welded to them and are uniformly distributed over the periphery. The annular outer part 7 is provided on the turbine side with an annular sealing strip 10, which is flush with the contour of the turbine flow channel on the cylinder side. In the cavity inside the inner part 6 is disposed the turbomachine mounting on the outlet side, the rotor 1 lying in a supporting bearing 4.

The turbine casing 3 carrying the radial ribs 22 is provided with a horizontal junction plane (not shown) lying in the machine axis 13. The usually flanged top and bottom halves of the turbine casing are bolted together in this plane.

Figure 2:
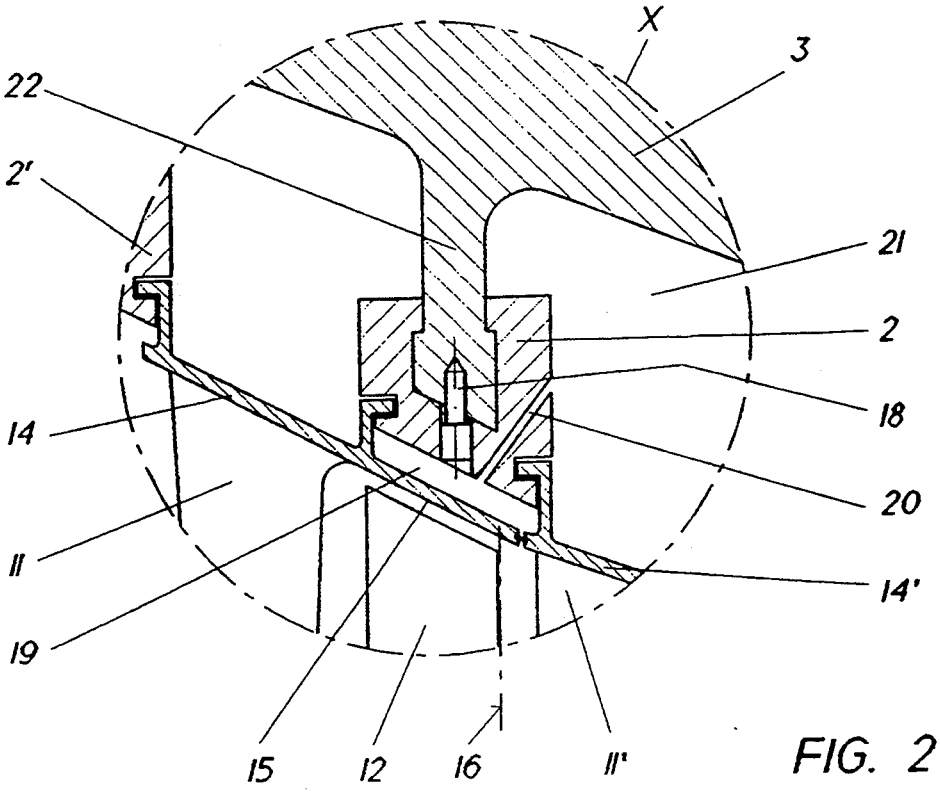
FIG. 2 is a view on a larger scale of the detail X in FIG. 1.

As can be seen in the detail view in FIG. 2, the guide vanes 11 are guided by their roots 14 in the segments 2. The root 14 of each guide vane is for this purpose provided, on its side remote from the flow duct, with straps which engage in corresponding grooves in the segments 2. Each root is guided by means of such a strap in two vane carrier segments 2, 2' adjoining one another in the axial direction.

Figure 2A:
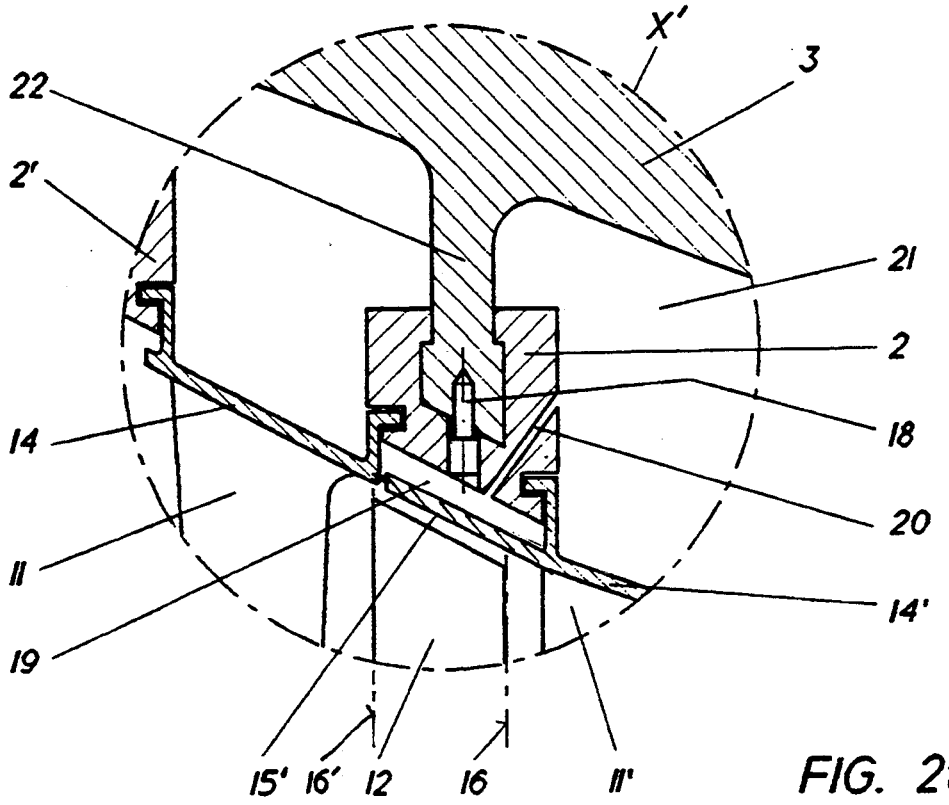

The roots 14 of the guide vanes 11 are provided with a collar 15 which is flush with the flow-limiting surface of the vane root. The collar extends in the axial direction as far as the inlet plane 16 of the rotor blade 12 disposed on the upstream side. In this plane the collar makes a seal against the root 14' of the preceding guide vane 11'. FIG. 2*a* illustrates an alternative embodiment in which the collar 15' extends in the downstream direction to the outlet plane 16' of the axially adjacent rotor blade 12.

The annular space 19 bounded by a segment 2, the collar 15 facing it and the side straps of two adjoining roots 14, 14' is in communication with a cooling air space 21 by way of a bore 20 provided in the vane carrier segment. The air penetrating through this bore 20 escapes from the annular space 19 through the seal between the collar 15 and the root 14'.

Figure 5:
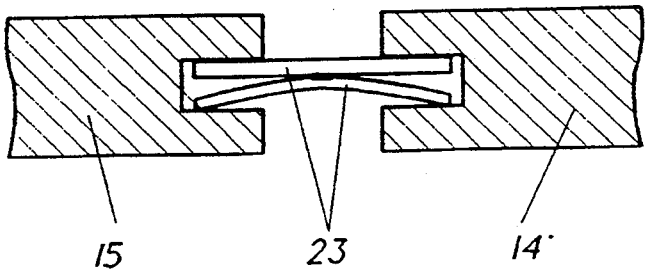
FIG. 5 shows an axial seal between two adjoining vane roots.

FIG. 5 shows an example of a seal of this kind. This seal comprises two spring sheets 23 which are tacked together at the center and rest in grooves in the root 14' and in the collar 15, thus providing a good seal while allowing free thermal movability of the elements concerned. In the peripheral direction one such sealing element will expediently be provided for each vane root. At their joint locations in the peripheral direction the cooling air referred to above can escape into the flow duct.

Figure 3:
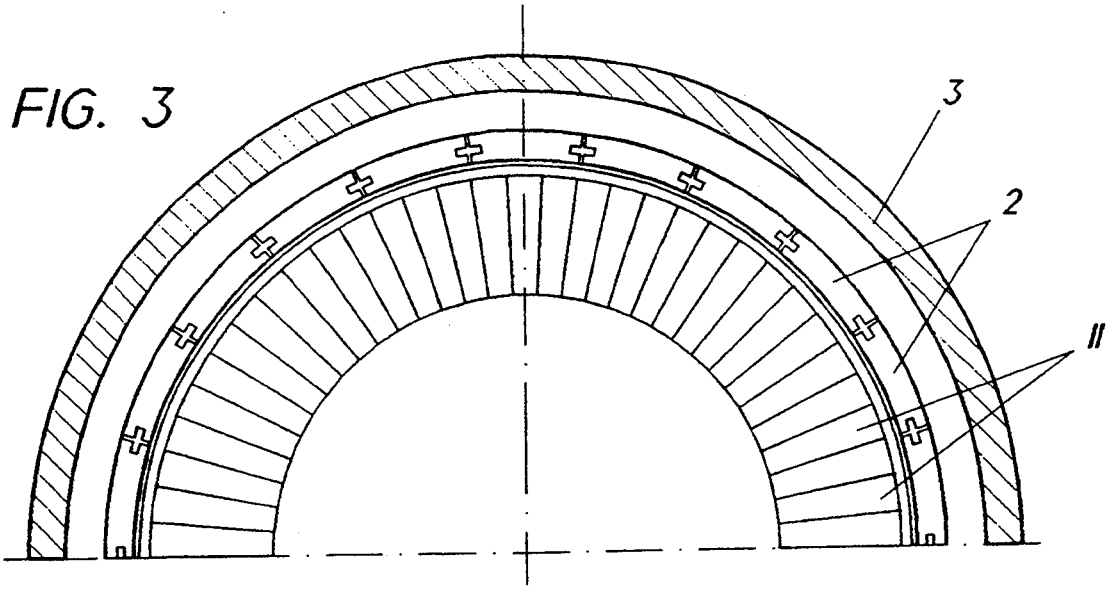
FIG. 3 is a partial cross section of the gas turbine.

As shown in FIG. 3, a vane carrier segment 2, after being equipped with vanes, comprises three vane roots 11 of the same guide row. Each segment is screwed in position in the turbine casing, that is to say to the corresponding radial rib 22 of the latter, by means of a stud bolt 18. These bolts are advantageously disposed in each case at the center of the segment—viewed in the peripheral direction.

Figure 4:
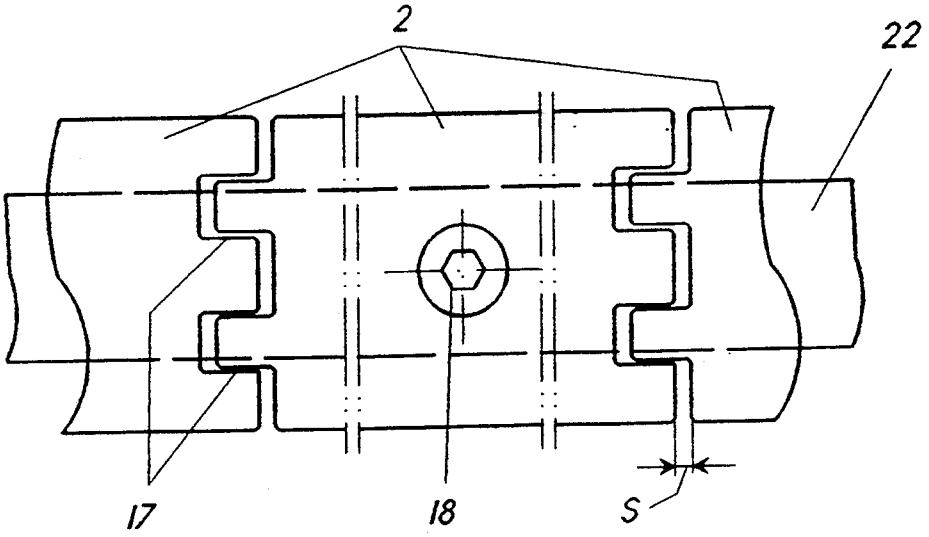
FIG. 4 is a view from below of a vane carrier segment.

For the mutual sealing of adjoining cooling air spaces 21, in which the cooling air may be in different states, the vane carrier segments 2 are provided at their ends on both sides with interengaging toothing 17, as can be seen in FIG. 4. This toothing 17 has the clearance S in the peripheral direction, in order to permit free expansion of the segments.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An axial-flow turbomachine, comprising:

machine casing having a plurality of ribs depending radially inward from the casing;

a plurality of vane carrier segments suspended coaxially on the ribs;

a plurality of guide vanes arranged in at least two axially spaced guide rows and mounted by roots to the vane carrier segments, the root of each guide vane engaging two vane carrier segments adjacent one another in an axial direction of the casing;

wherein the root of each guide vane includes a collar which forms part of a flow limiting surface bounding a flow duct and extends in the axial direction to one of at least an inlet plane of an axially adjacent rotor blade lying upstream of the guide vane and to an outlet plane of an axially adjacent rotor blade lying downstream of the guide vane, and the collar having means to seal the collar against a root of a guide vane adjacent the rotor blade.

2. A turbomachine as claimed in claim 1, wherein the vane carrier segments and the adjacent collar bound an annular space, each vane carrier segment having a bore connecting the annular space with a cooling air space.

3. A turbomachine as claimed in claim 1, wherein each vane carrier is formed with teeth on opposite sides to mate with complementary teeth of a circumferentially adjacent vane carrier segment.

4. A turbomachine as claimed in claim 1, wherein at least three vane guide roots in each guide row are mounted to a single vane carrier segment.

5. A turbomachine as claimed in claim 1, wherein the vane carrier segments are secured to the ribs in the machine casing by screws.

* * * * *